United States Patent [19]

Hollweck

[11] Patent Number: 4,587,508

[45] Date of Patent: May 6, 1986

[54] BIMETAL SWITCH ASSEMBLY

[75] Inventor: Walter Hollweck, Nuremberg, Fed. Rep. of Germany

[73] Assignee: Inter Control Hermann Köhler Elektrik GmbH & Co. KG, Nuremberg, Fed. Rep. of Germany

[21] Appl. No.: 674,863

[22] Filed: Nov. 26, 1984

[30] Foreign Application Priority Data

Nov. 26, 1983 [DE] Fed. Rep. of Germany ... 8334094[U]

[51] Int. Cl.[4] ..... H01H 37/74

[52] U.S. Cl. ..... 337/343; 337/338; 337/347

[58] Field of Search ..... 337/337, 338, 339, 340, 337/343, 347, 349, 363, 365, 368, 86

[56] References Cited

U.S. PATENT DOCUMENTS 4,476,453 10/1984 Hollweck ..... 337/347

FOREIGN PATENT DOCUMENTS 1970622 10/1967 Fed. Rep. of Germany .

*Primary Examiner*—Harold Broome
*Attorney, Agent, or Firm*—Spencer & Frank

[57] ABSTRACT

A bimetal circuit breaker switch assembly has two parallel, side-by-side arranged snap switches associated with two circuits independent from one another, a plate-like bimetal element which is, at its arcuately moving free end, operatively connected with the actuating ends of the snap switches, and a desired value setter arranged approximately at right angles to the length dimension of the snap switches. To a freely swinging end of the transmitting element there is secured a snap spring which is biased and which is stamped out of the plate material forming the snap contacts. The movable end of the bimetal element is formed of spaced legs bent generally perpendicularly to the bimetal element. The transmitting element includes a first spring plate in contact with the desired value setter and a second spring plate disposed parallel spaced from the first spring plate and divided into two spring legs having free ends bent generally perpendicularly to the spring legs. Each snap contact comprises an approximately rectangular frame having a cut and bent-out inner area forming the respective snap spring. The frame has a transverse terminal web constituting the actuating end of the respective snap switch. The free end of each snap spring is supported by respective spring legs under bias of each snap spring. Each terminal web straddles a respective terminal leg of the bimetal element under a tensioning bias of each frame. Two separate setting lugs, one being a setscrew, are arranged between the first and second spring plates.

7 Claims, 6 Drawing Figures

FIG. 3
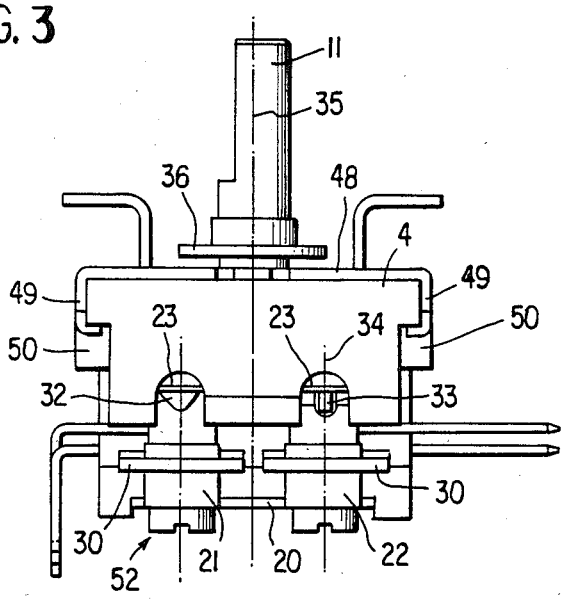
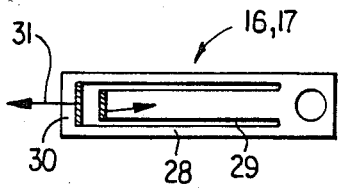
FIG. 4

BIMETAL SWITCH ASSEMBLY

BACKGROUND OF THE INVENTION

This invention relates to a bimetal circuit breaker switch assembly which is of the type that has two parallel, side-by-side arranged snap switches associated with two circuits independent from one another, a plate-like bimetal element which is, at its arcuately moving free end, operatively connected with the actuating ends of the snap switches, and a desired value setter arranged approximately at right angles to the length dimension of the snap switches. The desired value setter may be advanced or withdrawn by virtue of a threaded engagement and is in contact with a cantilevered transmitting element positioned parallel to the snap switches. To a freely swinging end of the transmitting element there is secured a snap spring which is biased and which is stamped out of the plate material forming the snap contacts. The two snap switches as well as the transmitting element are accommodated in a common insulator housing.

A circuit breaker of the above-outlined type is disclosed, for example, in German Gebrauchsmuster (Utility Model) No. 1,970,622.

Bimetal switches of the above type which have first and second independent snap switches are used with preference in heating devices which have two separate heating coils. In these devices, for a first heat-up range the main current contacts of both switches are closed, while in an upper temperature range the terminal heat-up is effected only by one of the two circuits. Stated differently, the main current contacts of the second switch have to be open in such a terminal heat-up phase.

If the temperature exceeds a preset maximum value, the main current contacts of the second snap switch also open. If the temperature slightly drops below the upper tripping point, a room temperature regulation is effected exclusively by a closing and opening of the second snap switch.

If the temperature falls below the tripping point of the first snap switch, the contacts of both snap switches should close in response, to ensure that a rapid heat-up of the room to the desired temperature will again follow. Known switches which in most cases are situated in the immediate vicinity of the heat sources, do not perform in this respect with satisfactory results. At the moment of closing the second snap switch as the temperature drops below the upper maximum tripping temperature, the heat radiated from the second heating coil, and affecting the bimetal is so high that a regulation is, disadvantageously, effected solely with the second heating coil since only the second snap switch is switched on and off. Stated differently, the first heating coil (in which the current flow is controlled by the first snap switch) is not energized at all, resulting in a slow cooling of the environmental temperature of the heating element and thus the regulating system does not respond within a certain comfort range.

SUMMARY OF THE INVENTION

It is an object of the invention to provide an improved bimetal circuit breaker which eliminates the above-outlined disadvantageous regulating behavior by ensuring that the two snap switches open in response to different temperatures, but close in response to the same temperature.

This object and others to become apparent as the specification progresses, are accomplished by the invention, according to which, briefly stated, the movable end of the bimetal element is formed of spaced legs bent generally perpendicularly to the bimetal element. The transmitting element includes a first spring plate in contact with the desired value setter and a second spring plate disposed parallel spaced from the first spring plate and divided into two spring legs having free ends bent generally perpendicularly to the spring legs. Each snap contact comprises an approximately rectangular frame having a cut and bent-out inner area forming the respective snap spring. The frame has a transverse terminal web constituting the actuating end of the respective snap switch. The free end of each snap spring is supported by respective spring legs under bias of each snap spring. Each terminal web straddles a respective terminal leg of the bimetal element under a tensioning bias of each frame. Two separate setting lugs, one being a setscrew, are arranged between the first and second spring plates.

By virtue of the above-outlined simple structural measures there is obtained a precise switching behavior according to which the circuits may be closed at the desired temperature levels. This is achieved by the fact that the temperature setting means as well as the transmitting and securing means on the switching elements are of relatively simple construction and permit a reproduceability of the adjusting steps required for an accurate setting.

According to a further feature of the invention, one of the transmitting lugs, constituted by a screw which may be longitudinally displaced by threading movement, is situated laterally spaced from and parallel to the direction of advance of the desired value setter and further, to the shaft of the desired value setter, projecting from the housing, there is secured a disc which rotates therewith as a unit and which is provided with a cutout aligned with the threaded bore for the transmitting lug only in one predetermined angular position. This feature ensures that the setting of the screw in the transmitting element can be effected only in a very precisely defined position of the desired value setter and thus a preadjustment of the switch is significantly facilitated.

According to a further feature of the invention, the above-noted cutout of the disc is aligned with the threaded bore in a terminal position of the desired value setter, determined by a terminal abutment. This feature results in a further simplification of the preadjustment.

According to further features of the invention, an upper spring plate of the transmitting element is, in the zone of its secured end, provided with a transverse opening. Further, the upper and lower spring plates are affixed jointly to the housing by means of mounting projections which straddle the same and which form part of at least one contact terminal. These features represent further structural improvements in the zone of the transmitting element. The upper spring plate, for a uniform transmission of the angular position of the desired value setter should be stabilized against an undesired lateral tilting but, at the same time, should not exert a significant spring force against the pressure of the desired value setter. The transverse opening thus provides for a two-point support in its mounting end. The above-noted mounting feature ensures a durable connection of the transfer element with the contact elements.

According to still another feature of the invention, the shaft of the desired value setter is engaged by an inner thread of a metal holding plate mounted on the housing. The metal holding plate surrounds at least partially the lateral walls of the housing with claw-like projections. These features ensure a play-free support of the desired value setter as well as its position relative to the housing even after extended service of the switch.

According to still a further feature of the invention, the spring plates are accommodated in a housing depression whose open lower side is covered by the plate-like bimetal element. These features provide for a secure and precise determination of the switching points and are reliably protected from damages.

BRIEF DESCRIPTION OF THE DRAWINGS

FIG. 3 is a front elevational view taken in the direction of the arrow III of FIG. 2.

FIG. 4 is a top plan view of a component of the preferred embodiment.

DESCRIPTION OF THE PREFERRED EMBODIMENT

Figure 1:
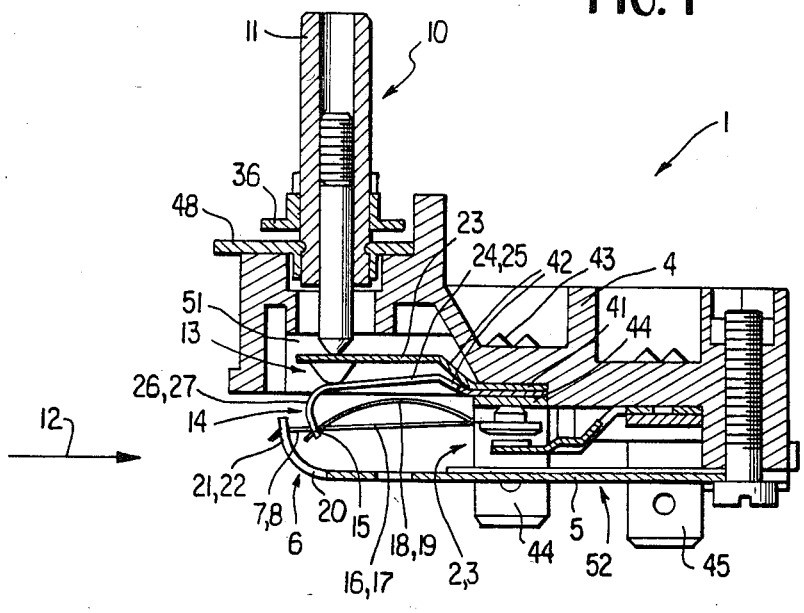
FIG. 1 is a sectional elevational view of a preferred embodiment taken along line I—I of FIG. 2.
Figure 2:
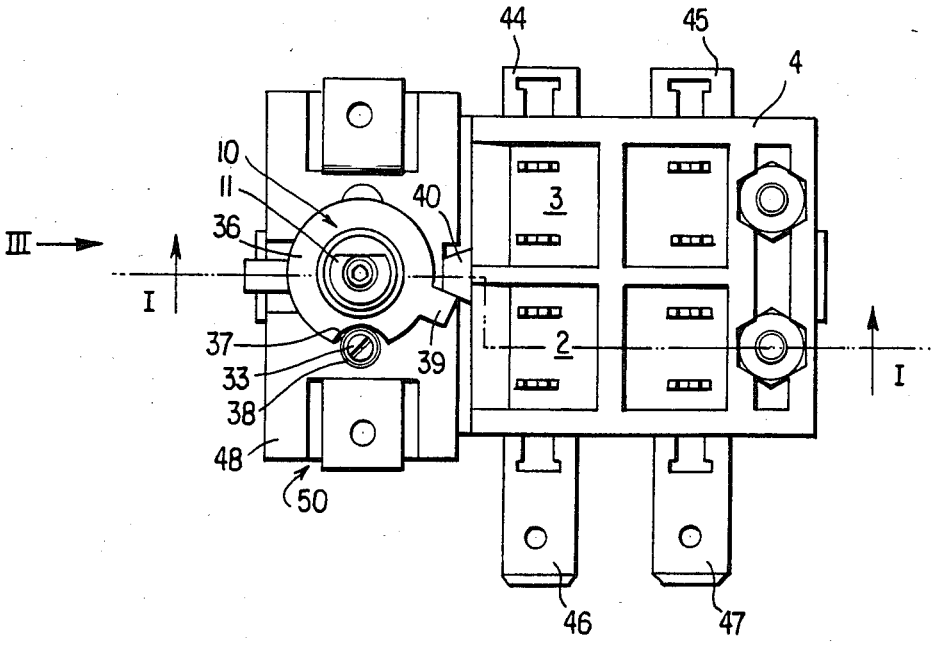
FIG. 2 is a top plan view of the construction shown in FIG. 1.
Figure 5:
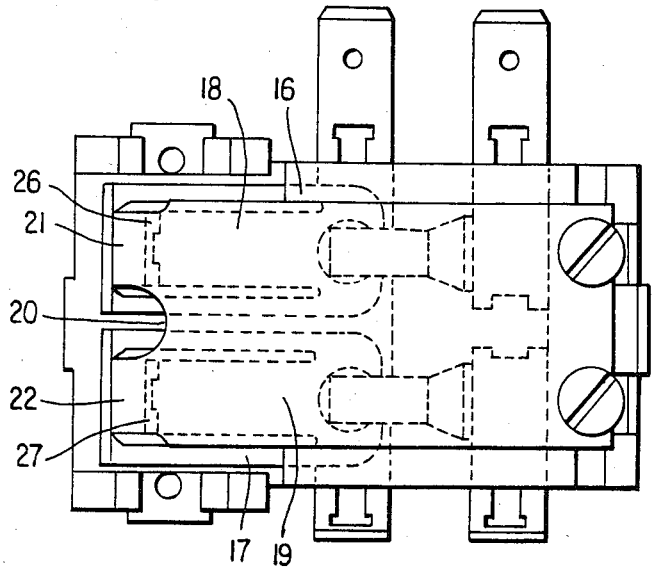
FIG. 5 is a partially broken-away bottom plan view of the construction shown in FIG. 1.
Figure 6:
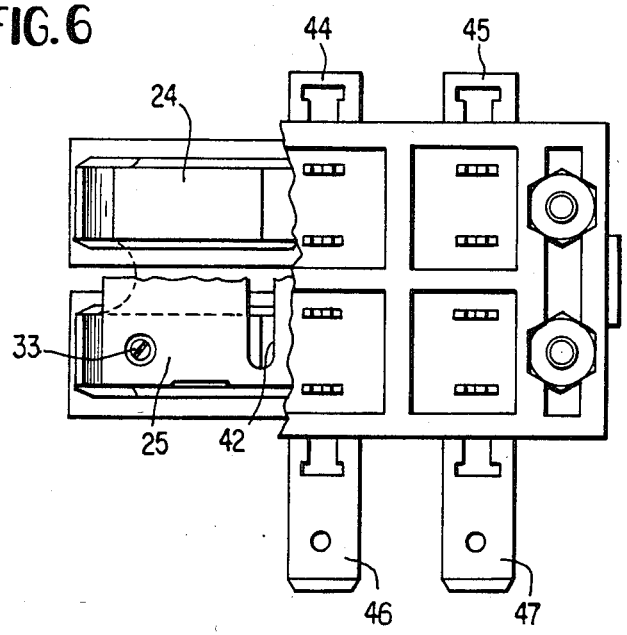
FIG. 6 is a partially broken-away top plan view of the construction shown in FIG. 1.

Turning now to FIGS. 1, 2, 5 and 6, the bimetal switch assembly 1 comprises two snap switches 2 and 3 which are situated side-by-side in a parallel relationship and are accommodated in a common housing 4. A plate-like bimetal element 5 is, at its arcuately travelling end portion 6 operatively connected with the two actuating ends 7 and 8 of the respective snap switches 2 and 3. A common desired value setter 10, having a shaft 11 projecting upwardly from the housing 4, extends approximately perpendicularly to the direction 12 in which the two snap switches 2 and 3 are arranged side-by-side. Further, the desired value setter 10 engages a force transmitting element 13 which is mounted in a cantilevered manner in the housing 4 and at an arcuately movable terminus 14 of which the free ends 15 of snap springs 18 and 19 are secured. The springs 18 and 19 are biased in the direction 12 and are integral, stamped-out parts of movable contacts 16, 17 associated with the respective snap switches 2 and 3.

The outer terminus 6 of the bimetal element 5 comprises forked legs 21, 22 separated by a U-shaped cutout 20. The legs 21 and 22 flanking the cutout 20 are bent upwardly at right angles to the main body of the bimetal 5, towards the snap switches 2 and 3.

The force transmitting element 13 is formed of an upper spring plate 23 and, parallel thereto, of two lower spring plates 24 and 25 lying in a single plane. The lower spring plates 24 and 25 are longitudinally medially separated and have respective spaced ends 26 and 27 which are bent downwardly in the direction of the bimetal element 5 and which constitute the above-noted arcuately movable terminus 14. The bent ends 26 and 27 of the lower spring plates 24 and 25 as well as the legs 21 and 22 of the bimetal 5 are situated side-by-side and spaced from one another horizontally, in a direction perpendicular to the arrow 12.

Also turning now to FIG. 4, the movable contacts 16 and 17 of the snap switches 2 and 3, respectively, are each formed of an approximately rectangular frame 28 which has an inner area 29 from which the snap springs 18 and 19 are cut and bent out. The free ends 15 of the springs 18 and 19 engage, with a bias oriented towards their mounting ends, the downwardly bent divided (forked) ends 26 and 27 of the lower spring plates 24 and 25. By means of this arrangement, the transverse frame webs 30 which straddle the upwardly bent legs 21 and 22 of the bimetal member 5 exert, against the bias of the springs 18 and 19, a tensioning force oriented in the direction of the arrow 31 in FIG. 4, so that the springs 18 and 19 are supported only by being tensioned on the ends 26 and 27 of the respective lower spring plates 24 and 25 and the legs 21 and 22 of the bimetal plate 5 are supported only in their biased clamping seat.

Between the upper spring plate 23 and the lower spring plates 24 and 25 there are arranged two separate setting pressure transmiting lugs 32 and 33. Only the lug 33 is a longitudinally advanceable screw whose longitudinal axis 34 is oriented laterally spaced from and parallel to the center line 35 of the path of movement of the shaft 11 of the desired value setter 10. On the shaft 11 there is mounted a disc 36 which is provided with a cutout 37 which, in turn, in an angular position (desired value position) of the disc 36 is in alignment with the threaded bore 38 accommodating the force transmitting lug 33. This arrangement ensures that the lug 33 can be adjusted only when the desired value setter 10 is in a predetermined angular position.

On the disc 36 there is further mounted a stop 39 which cooperates with a counterstop 40 mounted on the housing 4 in such manner that in a terminal angular position of the desired value setter 10 the cutout 37 is in alignment with the threaded bore 38.

The upper spring plate 23 of the force transmitting element 13 is, in the zone of its secured end 41, provided with a transverse cutout 42 which ensures that the spring plate 23 is mounted only by means of two relatively readily flexible edge webs.

To the housing 4 there are jointly secured the upper spring plate 23 and the two lower spring plates 24 and 25 by means of straddling securing projections 43 of at least one contact terminal 44. Further contact terminals 45, 46 and 47 project from the housing 4 and, with the contact terminal 44, constitute the main current contacts.

The shaft 11 of the desired value setter 10 is in threaded engagement with an inner thread of a metallic support plate 48 which is in a face-to-face contact with the housing 4 and which has tabs 49 surrounding at least partially the lateral housing walls 50 in a claw-like manner, as seen in FIG. 3.

The spring plates 23, 24 and 25 are accommodated as a stack in a housing depression or niche 51 whose open underside 52 is essentially entirely covered by the plate-like bimetal element 5.

The value setter 10 is used to set a certain operating temperature within the calibrated operating range (operated by the user). The setscrew 33 adjusts the operating point of one snap switch in coordination with the other snap switch (factory calibrated). Usually, the maximum temperature of the operating range is calibrated by means of the value setter (inner setscrew) due to factory calibration. It is therefore an advantage to use this angular position of the value setter at the same time to calibrate the transmitting setscrew 33. On the end position the recess 37 of the disc 36 provides access to the setscrew 33.

It will be understood that the above description of the present invention is susceptible to various modifications, changes and adaptations, and the same are intended to be comprehended within the meaning and range of equivalents of the appended claims.

What is claimed is:

1. In a bimetal switch assembly including an electrically insulating housing; two snap switches accommodated in said housing in a side-by-side, parallel arrangement and adapted to control two independent electric circuits; each said snap switch having a switch actuating end and a snap contact adapted to be associated with a respective separate circuit; a plate-like bimetal element secured to said housing and having an end movable in an arcuate path and operatively connected with said switch actuating ends of said snap switches; a common desired value setter having a longitudinal axis oriented generally perpendicular to a length dimension of said snap switches; thread means connected with said desired value setter for providing for a longitudinal displacement of said desired value setter upon turning motion thereof; a force transmitting element having a first end secured to said housing and an arcuately movable second end operatively connected with an end of said desired value setter; each said snap switch having a snap spring integral with the respective snap contact and having a free end; the free end of each said snap spring being secured to said second end of said force transmitting element under bias of the respective snap spring; the improvement wherein said end of said bimetal element has a generally U-shaped cutout separating terminal legs constituting said end of said bimetal element; said terminal legs being bent generally perpendicularly to said bimetal element and being oriented towards said housing;

said force transmitting element includes a first spring plate being in contact with said desired value setter and a second spring plate disposed parallel spaced from said first spring plate; said second spring plate being divided in a direction parallel to said length dimension of said snap switches for defining two spring legs constituting said second spring plate; said spring legs having free ends bent generally perpendicularly to said spring legs and being oriented towards said bimetal plate;

each said snap contact comprises an approximately rectangular frame having a cut and bent-out inner area forming the respective said snap spring; said frame has a transverse terminal web constituting said switch actuating end of the respective snap switch;

said free end of each said snap spring is supported by respective said spring legs of said second spring plate under bias of each said snap spring;

said terminal web of each said frame straddles a respective said terminal leg of said bimetal element under a tensioning bias of each said frame directed opposite the bias of the snap springs; and two separate setting lugs arranged between said first and second spring plates; one of said setting lugs being a setscrew.

2. A bimetal switch assembly as defined in claim 1, wherein said setscrew is situated laterally of and parallel to said longitudinal axis of said desired value setter; further wherein said desired value setter has a shaft projecting from said housing; a disc affixed to said shaft for rotation therewith; said disc having a cutout being aligned with said setscrew solely in a predetermined angular position of said disc.

3. A bimetal switch assembly as defined in claim 2, further comprising a stop supported by said housing; said stop cooperating with said desired value setter for determining an angular end position thereof; said cutout being in alignment with said setscrew in said angular end position of said desired value setter.

4. A bimetal switch assembly as defined in claim 1, wherein said first spring plate has a length dimension and an aperture oriented transversely to said length dimension and located in the zone of its attachment to said housing.

5. A bimetal switch assembly as defined in claim 1, further comprising a contact terminal having securing tabs fastened to said housing; said securing tabs straddling said first and second spring plates for clamping said first and second spring plates to said housing.

6. A bimetal switch assembly as defined in claim 1, further comprising a metal support plate engaging said housing face-to-face and having claw-like securing members at least partially surrounding said housing; said support plate having a threaded circular opening threadedly receiving said desired value setter.

7. A bimetal switch assembly as defined in claim 1, wherein said housing has a niche accommodating said first and second spring plates; said niche being covered by said bimetal element.

* * * * *